United States Patent [19]

Boda

[11] Patent Number: 4,925,410

[45] Date of Patent: May 15, 1990

[54] TILT MECHANISM LOCK FOR OUTBOARD MOTORS

[75] Inventor: James C. Boda, Winneconne, Wis.

[73] Assignee: Brunswick Corporation, Skokie, Ill.

[21] Appl. No.: 343,410

[22] Filed: Apr. 24, 1989

[51] Int. Cl.[5] ..... B63H 21/26

[52] U.S. Cl. ..... 440/55; 248/642; 440/53; 440/90

[58] Field of Search ..... 440/53, 55, 900; 248/640, 642, 643

[56] References Cited

U.S. PATENT DOCUMENTS

| | | | |
|---|---|---|---|
| 4,331,430 | 5/1982 | Lutzke et al. | 440/53 |
| 4,472,148 | 9/1984 | Kollock et al. | 440/53 |
| 4,759,733 | 7/1988 | Nishimura | 440/55 |
| 4,826,459 | 5/1989 | Slattery | 440/55 |
| 4,846,740 | 7/1989 | Forsgren | 440/53 |

*Primary Examiner*—Sherman D. Basinger

*Assistant Examiner*—Thomas J. Brahan

*Attorney, Agent, or Firm*—Andrus, Sceales, Starke & Sawall

[57] ABSTRACT

A conventional tilt mechanism for an outboard motor which includes a series of trim position notches and an uppermost trailering position notch includes a tilt position locking mechanism which is manually operable to lock the motor in the trailering position to positively prevent downward movement therefrom, either intentionally or inadvertently as a result of a shock load or jarring of the motor. The tilt locking mechanism is incorporated completely into one of the clamping members of a conventional tilt mechanism such that it does not interfere whatever with conventional operation of the tilt mechanism when in the unlocked position or with movement of the motor to the trailering position when in the locked position. However, downward movement of the motor when the mechanism is in the locked position is absolutely precluded.

10 Claims, 3 Drawing Sheets

TILT MECHANISM LOCK FOR OUTBOARD MOTORS

BACKGROUND OF THE INVENTION

The present invention relates to a mechanism for tilting an outboard motor about a horizontal axis relative to its mounting bracket and the boat transom and, more particularly, to a locking apparatus for the tilt mechanism for preventing inadvertent displacement of the outboard motor from its upper most trailering position.

U.S. Pat. Nos. 4,331,430 and 4,472,148 and 4,826,459, all of which are assigned to the assignee of the present invention, describe similar mechanisms for providing a variety of outboard motor tilt positions. The positions typically include a series of lower trim positions, including one or more shallow water drive positions, and an uppermost trailering position. These patents and the pending application describe alternate mechanisms for selecting and establishing the various tilt positions and moving the motor between them. In particular, U.S. Pat. No. 4,472,148 discloses a mechanism which allows the operator to change positions simply by pushing down on the motor tiller handle and tilting the engine up. A ratchet mechanism allows stepwise movement between a trim pin and serially arranged position notches to allow the motor to be tilted from the original down position to any higher position, including the uppermost trailering position, without activating any supplemental mechanism. To bring the motor back down to the original position, and depending upon which upper position it has been temporarily moved to, the motor is tilted up to and slightly beyond the uppermost shallow water drive position or the top trailering position, and released. The trim pin follows a return path in a closed circuit cam track that returns the trim pin and motor to its original position as the engine tilts down.

Although the mechanism of U.S. Pat. No. 4,472,148, as well as those of the other prior art mechanisms identified above, has operated satisfactorily, it has been found that in some situations the motor may be inadvertently dislodged from its uppermost trailering position. For example, where the outboard motor is used as an auxiliary engine and is in its trailering position because the main drive unit is being used, the pounding from heavy seas or high wave action may cause the motor to become dislodged and dropped from its trailering position. Likewise, when the motor is being trailered in its full up trailering position, jarring of the trailer as it travels over a road or ground surface may also cause the motor to be disengaged from the trailering position. In either situation, inadvertent disengagement from the trailering position will allow the motor to drop about its tilt axis resulting in possible damage to the motor.

It would be desirable, therefore, to have a manually operable lock mechanism by which the motor could be locked in its uppermost trailering position in a simple, but reliable, manner. In addition, such a lock mechanism would most desirably be able to be incorporated into an existing outboard motor tilt mechanism without major modifications or redesign, and without affecting its operation.

SUMMARY OF THE INVENTION

The present invention provides a lock for an outboard motor tilt mechanism which is manually operable to selectively lock the motor in its uppermost trailering position such that it cannot be inadvertently dislodged by bouncing or jarring, either while the boat is being operated or when it is being trailered. The lock apparatus of the present invention may be incorporated into a conventional prior art tilt mechanism with only a few minor modifications and added components, and without affecting in any manner the operation of the tilt mechanism.

The tilt mechanism with which the tilt lock of the present invention is used includes a transom bracket having a cam track which defines a plurality of trim position notches spaced circumferentially about a first horizontal axis. A swivel bracket for carrying the outboard motor is pivotally attached to the transom bracket for rotation about the first axis. A pawl assembly, pivotally attached to the swivel bracket on a second horizontal axis, includes a free end adapted to move along the cam track and into engagement with the notches to provide a series of angular tilt positions for the swivel bracket and attached motor. The cam track includes a return path which is engageable by the other end of the pawl assembly for returning the swivel bracket from any higher position, including the uppermost trailering position, to a lower position. Biasing means urges the other end of the pawl assembly into engagement with one of the notches as the swivel bracket is pivoted upwardly about the first axis. The biasing means also causes the free end of the pawl assembly to engage the return path in the cam track for return movement from an intermediate trim position or from the trailering position. The locking means is operable to selectively block movement of the end of the pawl assembly along the return path from the trailering position, thereby locking the swivel bracket in the trailering position.

The pawl assembly comprises a trim pin carrier including a trim pin attached to the other end thereof and extending generally parallel to the first and second axes. The trim pin has end portions which are adapted to engage the cam track. One end of the trim pin is spring biased into engagement with the portion of the cam track including the return path and the other end of the trim pin is disposed to engage the locking means when the latter is disposed in the locked position to block movement of the trim pin from the trailering notch in the cam track.

In accordance with the preferred construction, the transom bracket includes a first clamping member defining a first cam track and a second clamping member defining a second cam track. The first cam track is engageable by the spring biased end of the trim pin, and the locking means is mounted within the second cam track. The locking means comprises a locking shuttle which is disposed to slide in the second cam track between an unlocked position in which the adjacent end portion of the trim pin is unrestricted in movement into the trailering notch and return movement out of the trailering notch, and a locked position in which the end of the trim pin is unrestricted in movement into the trailering notch, but is restricted by engagement with the shuttle from return movement out of the trailering notch.

DETAILED DESCRIPTION OF THE PREFERRED EMBODIMENT

Figure 1:
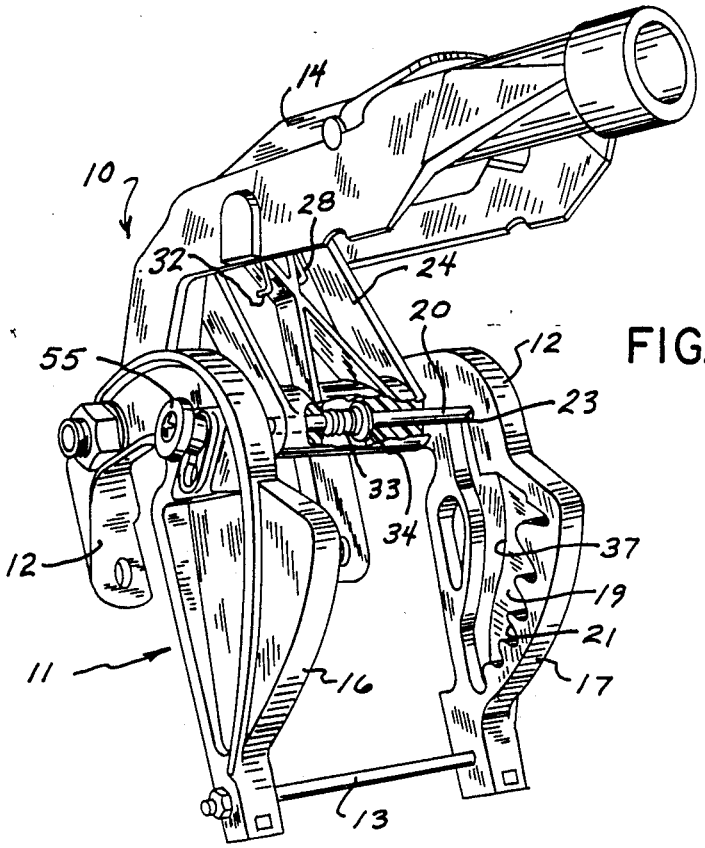
FIG. 1 is a perspective view of a tilt mechanism utilizing the present invention.

In the drawing, a tilt mechanism 10 for an outboard motor includes a transom bracket 11 having a pair of clamps 12 for attachment to the transom of the boat. A swivel bracket 14 is pivotally attached to the transom bracket by a pivot tube 15 for rotation about a generally horizontal axis. An outboard drive unit (not shown) is mounted on the swivel bracket 14 in a conventional manner for tilting movement with the swivel bracket about the horizontal axis of the pivot tube 15. The transom bracket 11 includes port and starboard clamping members 16 and 17 held in a spaced relationship by the pivot tube 15 and a lower tubular cross member 13. The clamping members 16 and 17 have generally similar oppositely facing cam tracks 18 and 19, respectively, adapted to receive the ends of a trim pin 20 and hold the trim pin in one of a series of tilt positions. The cam tracks 18 and 19 in the clamping members 16 and 17 each has a set of corresponding notches, including a lower range of trim position notches 21, including a shallow water drive notch 22, and an uppermost trailering notch 23. The trim position notches 21 are disposed in a generally circumferentially spaced pattern about the axis of the pivot tube 15. The trailering notch 23 is spaced somewhat from and disposed above the trim position notches 21.

The trim pin 20 is carried in the cam tracks 18 and 19 in clamping members 16 and 17 by a trim pin carrier 24 pivotally attached to the swivel bracket 14 by a pivot rod 25 for rotation about a second generally horizontal axis parallel to the axis of the pivot tube 15. The trim pin 20 is mounted on the lower free end of the trim pin carrier 24. The trim pin carrier is spring biased by a torsional pawl spring 28 to provide a sternward bias force tending to move the trim pin carrier about the axis of the rod 25 toward the swivel bracket 14 and to cause the trim pin 20 to engage the trim position notches 21 and the trailering notch 23. The pawl spring 28 is mounted on the pivot rod 25 and includes a center portion 29 bearing against the center flange of the swivel bracket 14 and a pair of legs 30 each having a spiral portion 31 wrapped around the pivot rod 25 and a free hook end 32 engaging the surface of the trim pin carrier 24.

Referring to FIG. 1, the trim in 20 is slidably mounted in the lower end of the trim pin carrier 24 and is axially biased toward the starboard clamping member 17 by a coil spring 33. The coil spring 33 is compressed between one edge of the trim pin carrier 24 and a collar 34 on the trim pin 20. The coil spring 33 biases the starboard end of the trim pin 20 against the bottom surface 35 of the starboard cam track 19. The opposite port end of the trim pin 20 is disposed in the port cam track 18 but, over the full range of axial movement of the trim pin 20, remains spaced from the bottom surface 36 of the port cam track 18. However, both ends of the trim pin remain in a position to engage their respective set of trim pin notches 21 and trailering notch 23, as previously indicated.

Figure 2:
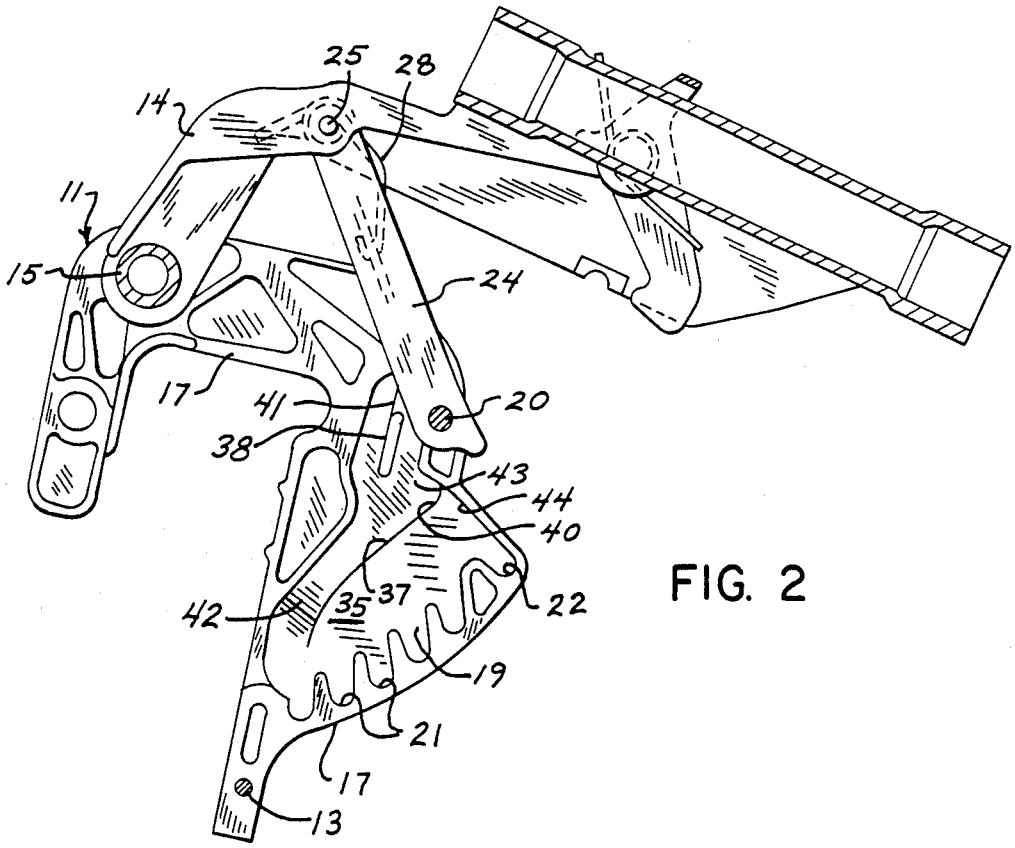
FIG. 2 is a vertical section through the tilt mechanism in the uppermost trailering position showing the position control surfaces in the starboard clamping member.
Figure 3:
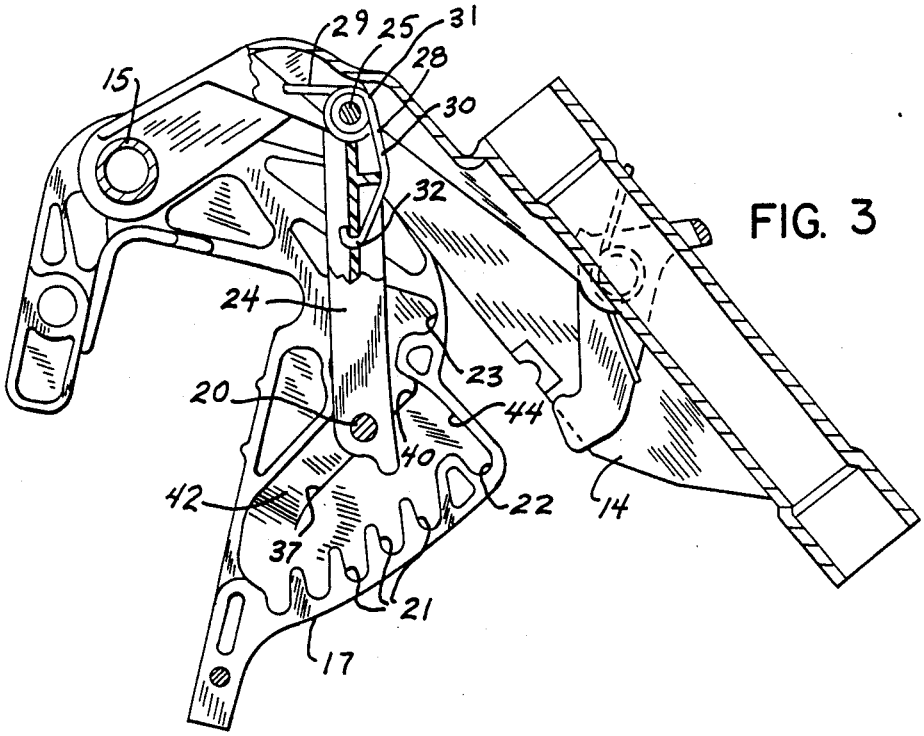
FIG. 3 is a view similar to FIG. 2 showing the tilt mechanism in an intermediate return position.

Referring to FIGS. 2 and 3, the cam track 19 in the starboard clamping member 17 forms two connected cam loops which are followed by the trim pin 20 as the swivel bracket 14 moves up and down between the lowermost trim position notch 21 and the trailering notch 23. The lower loop includes the trim position notches 21 (including shallow water drive notch 22) and a first return cam surface 37. The upper loop includes the trailering notch 23 and a second return cam surface 38. A first step 40 is formed in the bottom surface 35 of the starboard cam track 19 between the shallow water drive notch 22 and the trailering notch 23. A second step 41 is formed between the trailering notch 23 and the second return cam surface 38. The first step 40 allows the trim pin 20 be shift axially under the bias of coil spring 33 when the pin is raised past the step, allowing it to ride on the first return cam surface 37 as the swivel bracket 14 is lowered from the shallow water notch position. The second step 41 allows the trim pin 20 to shift axially, causing it to ride on the second return cam surface 38 as the swivel bracket is lowered from an uppermost trailering position. Thus, spring biased axial movement of the trim pin off of the first or second steps 40 or 41, respectively, and the bias of the pawl spring 28 forces the trim pin carrier 24 and trim pin into engagement with the respective return cam surfaces 37 or 38 as the swivel bracket is rotated downwardly about the pivot tube 15. The first return cam surface 37 may extend downwardly and terminate adjacent the lowermost trim position notch 21. The bottom surface 35 of the starboard cam track 19 adjacent the first return cam surface 37 includes a first ramp surface 42 which returns the trim pin 20 to an axial position corresponding to the top of the first step 40 as the trim pin 20 rides downwardly along the first return cam surface 37 and in axial engagement with the bottom surface 35. Similarly, a second ramp surface 43 slopes upwardly from the bottom of the first step 40 to the trailering notch 23, also causing the trim pin 20 to move axially to a position corresponding to the level of the top of second step 41 as the trim pin carrier carries the trim pin into engagement with the trailering notch 23.

The starboard cam track 19 may include a movable cam member which allows the selective choice of any of several trim position notches 21 to which trim pin may be returned from an upper position. This avoids the necessity of returning the swivel bracket (and trim pin) to the lowermost position, if return to a higher intermediate position is desired. The operation of the return cam is described in more detail in U.S. Pat. No. 4,472,148 and forms no part of the present invention.

When it is desired to tilt the motor up to the trailering notch 23 from any one of the trim position notches 21, the swivel bracket 14 is caused to be tilted about the axis of the pivot tube 15 and the trim pin 20 ratchets upwardly on the trim pin carrier 24. As the swivel bracket is rotated past the shallow water drive notch 22, the trim pin 20 rides along the rear wall 44 of the cam track 19 until it drops axially off the first step 40. From that point, the swivel bracket may be lowered and the trim pin allowed to move downwardly along the first return cam surface 37 to a lower trim position notch 21. Alternately, if the swivel bracket is continued to be rotated upwardly, the trim pin will move along the rear wall 44 and the end will engage the second ramp surface 43, causing the pin to shift axially as it moves into engagement with the trailering notch 23. The bias of the pawl spring 28 will cause the trim pin carrier and attached trim pin to engage the trailering notch 23 and hold the swivel bracket and attached motor in the uppermost trailering position. When it is desired to lower the motor from the uppermost position, the swivel bracket is tilted further upwardly, causing the trim pin 20 to ride along the upper surface of the trailering notch 23 until the pin end drops over the second step 41, causing the end of the trim pin to engage the second return cam surface 38. Downward rotation of the swivel bracket causes the trim pin to ride downwardly along the second return cam surface until it reaches the lower end thereof, after which the bias of the pawl spring 28 will carry the trim pin into engagement with the first return cam surface 37, as the swivel bracket continues to rotate downwardly.

With the swivel bracket in the uppermost trailering position, the starboard end of the trim pin 20 is in engagement with the trim pin notch 23 and the flat end of the pin is biased into engagement with the surface of the starboard cam track 19 at the top of the second ramp surface 43. Although, as indicated, the bias of the pawl spring 28 is adequate under most conditions to hold the swivel bracket and attached motor in the trailering position, occasional jarring of the motor when so positioned, such as may be caused by towing a trailered boat over a rough road, may cause the trim pin to inadvertently ride out of the trailering notch 23 to a point where the end drops off the second step 41. If that occurs, the motor will drop under its own weight to a full down position (or some preset intermediate trim position).

Figure 4:
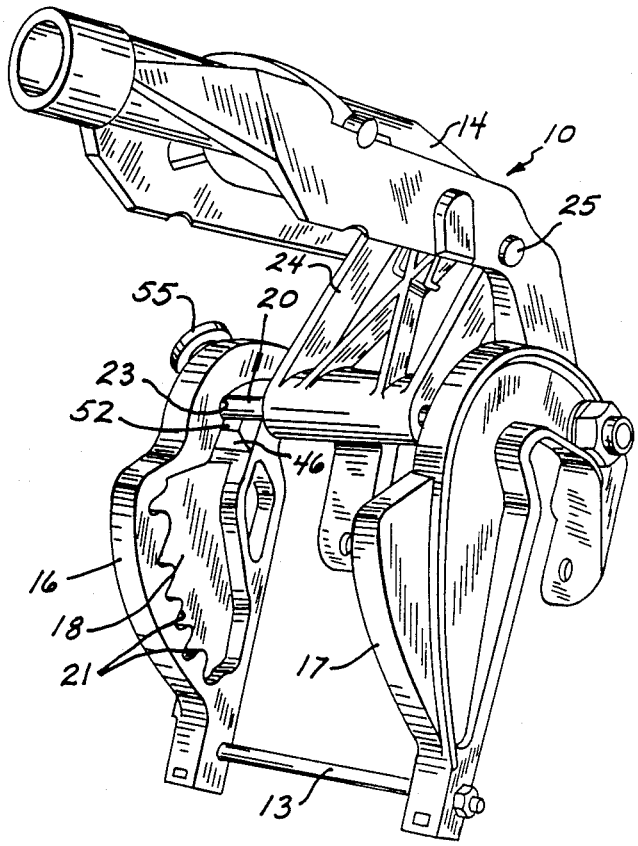
FIG. 4 is a perspective view similar to FIG. 1 taken from the opposite side of the tilt mechanism and showing the tilt lock.

Referring to FIG. 4, the port end of the trim pin 20 is also in engagement with the corresponding trailering notch 23 in the cam track 18 in the port clamping member 16. However, as previously indicated, the port end of the trim pin is shortened such that it does not engage the bottom surface 36 of the port cam track, regardless of the axial position of the trim pin resulting from its spring biased engagement with the bottom surface 35 of the starboard cam track 19.

Figure 5:
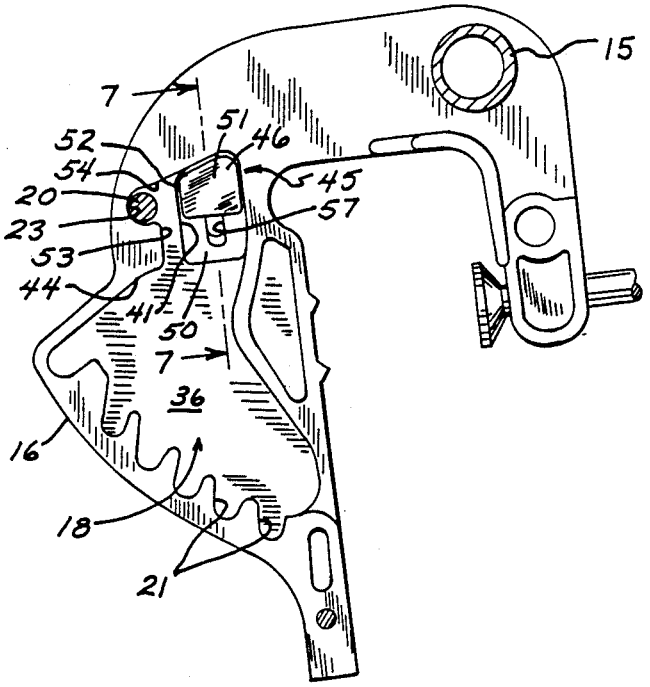
FIG. 5 is a vertical section through the mechanism showing the inside surface of the port clamping member with the tilt lock in the locked position.
Figure 6:
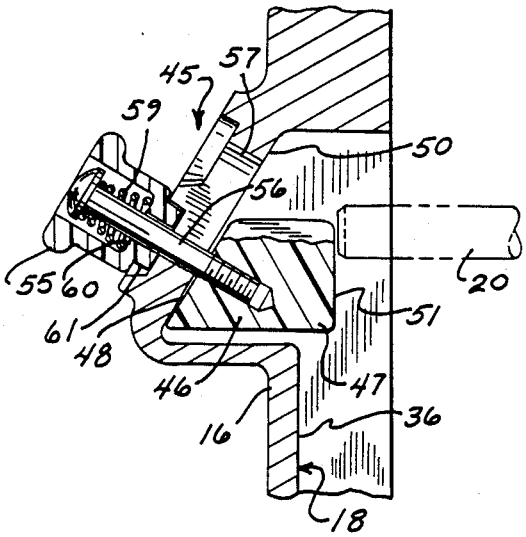
FIGS. 6 and 7 are similar sectional views taken on line 7—7 of FIG. 5 showing the unlocked and locked positions, respecitvely, of the tilt lock.
Figure 7:
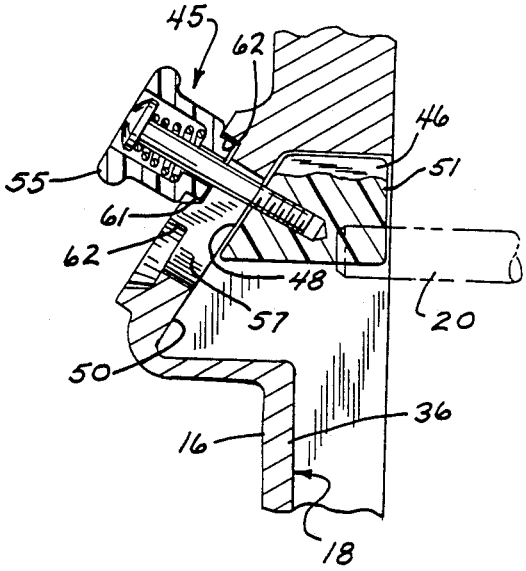

Referring also to FIGS. 5–7, the port clamping member 16 includes a tilt locking mechanism 45 that includes a locking position which may be selected by the operator to positively lock the swivel bracket in the trailering position and prevent inadvertent dislodgement of the trim pin 20 from the trailering notch 23. In general, the tilt locking mechanism includes a locking shuttle 46 which may be manually moved between a lower unlocked position in which the port end of the trim pin 20 is unrestricted in movement into or out of the trailering notch 23 and an upper locked position in which the port end of the trim pin is unrestricted in movement into the trailering notch, but is prevented from either intentional or inadvertent movement out of the trailering notch for downward return movement along the second return cam surface 38 in the starboard clamping member 17.

The locking shuttle 46 includes a generally block-shaped body 47 having an angled bottom surface 48 which lies against an inclined ramp 50 formed in the bottom surface 36 of the port cam track 18 just forward of the second step 41. The locking shuttle 46 includes a top surface 51 opposite the inclined bottom surface 48 and a blocking surface 52 adjacent the second step 41 and extending between the bottom and top surfaces 48 and 51. When the locking shuttle 46 is in the lower unlocked position at the lower end of the inclined ramp 50, its top surface 51 is disposed at its maximum distance and slightly spaced from the port end of the trim pin 20. In this position, the trim pin will completely clear the locking shuttle 46 as it moves upwardly past the rear wall 44 of the cam track 18 toward engagement with the trailering notch 23 or as it passes over the top of the top surface 51 as the opposite starboard end of the trim pin drops off the second step 41 and into engagement with the second return cam surface 38 in response to downward pivotal movement of the swivel bracket. If the locking shuttle is moved to the locked position by causing the shuttle to slide upwardly along the inclined ramp 50, the body 47 will simultaneously be shifted in an axial direction toward and slightly past the port end of the trim pin 20, such that in the locked position the top surface of the locking shuttle is actually disposed axially along the trim pin and the blocking surface 52 is engaged by the port end of the trim pin, in response to any movement of the swivel bracket tending to dislodge the trim pin from the trailering notch 23, to positively prevent such disengagement. However, with the locking shuttle 46 in the upper locked position, ample open space remains between the entry face 53 to the port side trailering notch 23 and the adjacent corner of the locking shuttle 46 to allow unrestricted passage of the trim pin from a lower trim position into the trailering notch. The bias of the pawl spring tending to hold the trim pin in the trailering notch 23 or against the exit face 54 thereof prevents reverse movement through the open space in response to movement tending to dislodge the pin from the trailering notch and, instead, causes the end of the trim pin to engage the blocking surface 52.

To facilitate manual movement of the locking shuttle 46 between the locked and unlocked positions, a control knob 55 is disposed on the outside face of the port clamping member 16 opposite the inclined ramp 50. The control knob 55 is attached to the locking shuttle 46 by a connecting screw 56 extending through an elongated slot 57 extending through the wall of the clamping member 16. The control knob 55 is biased toward the clamping member by a coil spring 59 supported on the connecting screw 56 between the screw head and a recessed surface 60 in the control knob. The inner axial end of the control knob includes a reduced diameter portion 61 adapted to engage one of the two enlarged blind recesses 62 at the ends of the slot 57 defining the locked and unlocked positions of the locking shuttle 46. To move the locking shuttle from one position to the other, the control knob 55 is pulled axially outwardly until the reduced diameter portion 61 clears the outer surface of the blind recess 62 and the control knob is slid along the slot to the other position, whereby the bias of the coil spring 59 causes the reduced diameter portion to engage the other blind recess 62.

The trailering position locking mechanism 45 is simple in construction and operation. In addition, it may be readily incorporated into an existing port clamping bracket 18 with few modifications. The casting from which the clamping bracket is typically made is simply modified to replace the second return cam surface 38 (forming a part of the starboard clamping member 17) with the inclined ramp 50 adjacent the second step 41.

The trim pin 20 is also shortened slightly to enable it to clear the outer top surface 51 of the locking shuttle 46 when the latter is in the unlocked position. In this manner, movement of the swivel bracket into and out of the trailering notch 23 is completely unrestricted. In addition, as indicated, with the locking shuttle in its locked position, the trim pin may still be moved into the trailering notch 23, but is positively prevented from moving inadvertently or being moved purposely out of the trailering position. Thus, when it is desired to utilize the trailering position locking mechanism 45, the boat operator may move the locking shuttle into the locked position either before the swivel bracket and attached motor are raised to the trailering position or after movement to the trailering position.

Various modes of carrying out the present invention are contemplated as being within the scope of the following claims particularly pointing out and distinctly claiming the subject matter which is regarded as the invention.

I claim:

1. A tilt mechanism for a marine propulsion device comprising:

a. a transom bracket for attachment to a boat, said transom bracket having cam track means including a plurality of trim position notches circumferentially spaced about a first generally horizontal axis and an uppermost trailering position notch;

b. a swivel bracket pivotally attached to the transom bracket for rotation about the first horizontal axis;

c. a pawl assembly having one end pivotally attached to the swivel bracket for rotation about a second generally horizontal axis, the other end of said pawl assembly being movable along the cam track means into engagement with said notches to provide a series of angular trim positions and a trailering position for the swivel bracket;

d. said cam track means including return path means engagable by the other end of said pawl assembly for returning the swivel bracket from a higher position to a lower position;

e. biasing means for urging the other end of the pawl assembly into a selected one of said notches and for providing engagement of said other end with said return path means for return movement therealong from an upper trim position and from the trailering position; and, f. locking means for selectively blocking movement of said other end along the return path means from the trailering position, thereby locking the swivel bracket in the trailering position.

2. The tilt mechanism as defined in claim 1 wherein said pawl assembly comprises a trim pin carrier including a trim pin attached to the other end thereof, said trim pin extending generally parallel to the first and second axes and having end portions adapted to engage said cam track means.

3. The tilt mechanism as defined in claim 2 wherein said trim pin is movable axially on said trim pin carrier, and said biasing means comprises a spring operatively connecting the trim pin and the carrier to bias the pin axially in one direction and maintain one end portion thereof in engagement with said return path means.

4. The tilt mechanism as defined in claim 3 wherein said locking means is manually operable for movement between a locking position and an unlocked position.

5. The tilt mechanism as defined in claim 4 wherein said locking means in the locked position is engagable by the other end portion of said trim pin to block movement of the other end of the pawl assembly along said return path means.

6. The tilt mechanism as defined in claim 5 wherein the transom bracket comprises a first clamping member and a second clamping member and wherein said first clamping member includes a first cam track engagable by said one end portion of the trim pin, and said second clamping member includes a second cam track, and wherein said locking means is mounted in said second cam track.

7. The tilt mechanism as defined in claim 6 wherein said locking means comprises a locking shuttle slidably disposed in said second cam track for movement between an unlocked position in which the other end portion of said trim pin is unrestricted in movement into said trailering notch and return movement therefrom, and a locked position in which said other end portion is unrestricted in movement into said trailering notch and is restricted by engagement with said shuttle from return movement out of said trailering notch.

8. The tilt mechanism as defined in claim 7 including an inclined ramp in the surface of the second cam track adjacent said trailering notch for slidably mounting said locking shuttle for movement between said locked and unlocked position.

9. The tilt mechanism as defined in claim 8 wherein said locking shuttle includes a blocking surface spaced axially from said other end portion of the trim pin in the unlocked position and disposed adjacent said other end portion in the locked position.

10. The tilt mechanism as defined in claim 6 wherein the cam tracks in said first and second clamping members each includes a plurality of trim position notches and a trailering position notch engagable by the respective end portion of said trim pin.

* * * * *